US008109731B2

(12) United States Patent
Keber et al.

(10) Patent No.: US 8,109,731 B2
(45) Date of Patent: Feb. 7, 2012

(54) RADIAL FAN IMPELLER

(75) Inventors: Roland Keber, Worth a.d. Isar (DE); Rudolf Tungl, Ergolding (DE)

(73) Assignee: ebm-papst Landshut GmbH, Landshut (DE)

( * ) Notice: Subject to any disclaimer, the term of this patent is extended or adjusted under 35 U.S.C. 154(b) by 112 days.

(21) Appl. No.: 12/646,032

(22) Filed: Dec. 23, 2009

(65) Prior Publication Data

US 2010/0098544 A1 Apr. 22, 2010

Related U.S. Application Data

(63) Continuation-in-part of application No. 11/658,906, filed as application No. PCT/EP2005/008250 on Jul. 29, 2005, now Pat. No. 7,794,206.

(30) Foreign Application Priority Data

Jul. 31, 2004 (DE) ..... 20 2004 012 015 U

(51) Int. Cl.
*F04D 29/30* (2006.01)

(52) U.S. Cl. ..... 416/186 R; 416/203; 416/223 B

(58) Field of Classification Search ..... 416/186 R, 416/203, 223 B
See application file for complete search history.

(56) References Cited

U.S. PATENT DOCUMENTS

| | | | | |
|---|---|---|---|---|
| 3,224,079 | A * | 12/1965 | Dybvig | 29/889.4 |
| 3,479,017 | A * | 11/1969 | Thikotter | 261/91 |
| 3,788,765 | A | 1/1974 | Rusak | |
| 3,865,506 | A | 2/1975 | Gerlach | |
| 6,249,071 | B1 * | 6/2001 | Lopatinsky et al. | 310/156.38 |
| 6,280,143 | B1 | 8/2001 | Parker et al. | |
| 6,558,120 | B2 * | 5/2003 | Kim et al. | 416/186 R |
| 7,121,799 | B2 * | 10/2006 | Kim et al. | 416/186 R |
| 7,163,374 | B2 * | 1/2007 | Lee et al. | 416/186 R |
| 7,165,938 | B2 * | 1/2007 | Lee et al. | 415/206 |
| 2002/0106277 | A1 | 8/2002 | Chapman | |
| 2003/0039548 | A1 | 2/2003 | Kim | |

FOREIGN PATENT DOCUMENTS

| | | | |
|---|---|---|---|
| CH | 301116 | | 8/1954 |
| DE | 441 359 | C | 3/1927 |
| DE | 4141359 | A1 | 6/1993 |
| DE | 42 04 531 | A1 | 8/1993 |
| DE | 10204037 | A1 | 8/2003 |
| EP | 0 410 271 | B1 | 1/1991 |
| EP | 1138954 | A | 10/2001 |
| FR | 2 335 714 | | 7/1977 |
| GB | 1129370 | | 10/1968 |
| GB | 1416882 | | 12/1975 |
| WO | 0245862 | A | 6/2002 |

* cited by examiner

*Primary Examiner* — Ninh H Nguyen
(74) *Attorney, Agent, or Firm* — Harness, Dickey & Pierce, PLC

(57) ABSTRACT

A radial fan impeller has the following features: a plurality of blades distributed around the periphery; viewed in the radial direction, the blades extend from an inner inlet region to an outer discharge region; the blades extend axially, viewed in the direction of a rotation axis, between an inlet side and an axially opposite hub side; on the inlet side, the blades are connected by means of their radial extension as far as the discharge region to a covering disc which has a central inflow opening, opening out into the inlet region; on the hub side the blades are only connected with their radial inner end regions to a central hub; the blades and the covering disc define an outer fan impeller diameter which is at least ten times an axially measured flow discharge width of the blades provided in the discharge region.

11 Claims, 5 Drawing Sheets

RADIAL FAN IMPELLER

CROSS-REFERENCE TO RELATED APPLICATIONS

Figure 1:
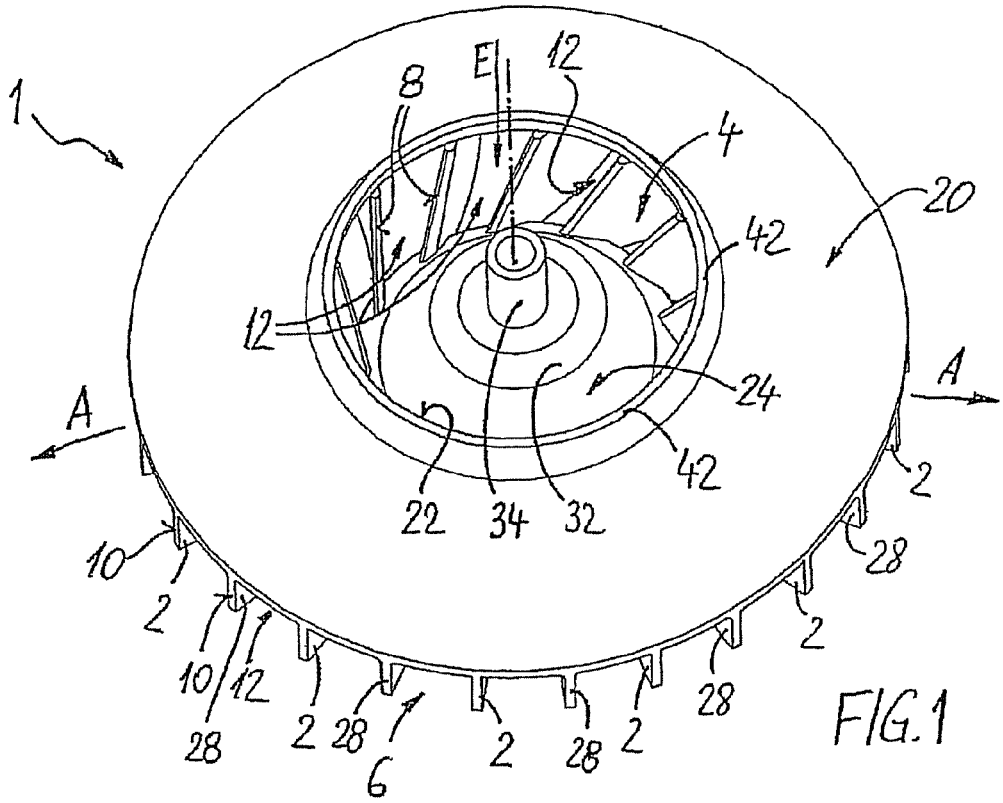

This application is a divisional of U.S. patent application Ser. No. 11/658,906 filed on Jan. 30, 2007 which is the National Stage of International Application No. PCT/EP2005/008250 filed Jul. 29, 2005. This application claims the benefit and priority of DE 20 2004 012 015.1, filed Jul. 31, 2004. The entire disclosures of the above applications are incorporated herein by reference.

FIELD

This invention relates to a radial fan impeller, in particular for using in gas fans with a steep fan characteristic curve.

BACKGROUND

This section provides background information related to the present disclosure which is not necessarily prior art.

EP 0 410 271 B1 describes a radial fan for conveying a gaseous medium in a device with high flow resistance, in particular a burner in a gas boiler. These types of burner have a relatively high flow resistance of in the region of 200 pascals or over. The medium to be conveyed can be air or a combustible gas/air mixture. The fan and the fan impeller of the same must therefore be designed to have a steep pressure/volume flow characteristic curve. This means that pressure changes should only be associated with small changes to the volume flow. For this, the known fan has a fan impeller, the diameter of which is more than ten times its flow discharge width. This is a closed wheel, covered on both sides, with a substantially flat lower portion having a central hub (first covering disc), a plurality of blades bent rearwards, and each being in the shape of a segment of a circle, and a circular, flat, plate-shaped cover (second covering disc) with a central, circular inlet opening.

Documents DE 41 41 359 A1, CH 301 116 and DE 102 04 037 A1 respectively describe similar fan impellers which are also closed, according to the first two documents shortened intermediary blades being provided.

These types of closed radial fan impeller, covered on both sides, are relatively difficult and expensive to produce.

A further radial fan is known from WO 02/45862 A2 which, however, has a fan impeller with a large axial length and flow discharge width in comparison with the diameter such that this fan is not suited, or is less well suited to the preferred application as a gas burner fan. This known fan impeller has blades which are all of the same length and is designed to be axially open on the hub side.

SUMMARY

This section provides a general summary of the disclosure, and is not a comprehensive disclosure of its full scope or all of its features.

The object which forms the basis of this invention is to provide a radial fan impeller which, with particular suitability for a gas burner fan with a steep characteristic curve, can be produced easily and cost-effectively.

According to the invention this is achieved respectively by the combination of features of claims 1 and 11. Preferred features of embodiments are the object of the dependent claims.

By designing the diameter to be at least ten times the flow discharge width of the blades, the desired steep characteristic curve is obtained. According to the invention, however, on their side facing away from the covering disc, the blades have free side edges which lie on a theoretical, level surface or any curved surface. By means of this embodiment of the fan impeller which, according to the invention, is open on this side, this can be produced very quickly and cost-effectively as a one-piece moulded part made of synthetic using a spraying method, in which a relatively simple spraying tool without or with just a few slides can be used because, due to the structure of the impeller, undercuts in the direction of demoulding can be avoided so that simple, axial demoulding of the moulded part is possible.

The radial fan impeller according to the invention is provided for use in a fan housing which has a wall adapted to the free blade side edges or to the theoretical surface shape defined by these such that between this wall and the fan impeller blades, only a narrow axial gap is formed.

The shortened intermediary blades respectively provided according to the invention between two blades have the advantage that, on the one hand, overall a relatively large number of blades and intermediary blades can be provided, and this is advantageous with regard to the flow movement in the flow channels formed between the blades with respect to air movement, flow displacement and the formation of swirl. On the other hand, however, the problem is avoided whereby with a correspondingly large number of long blades passing through to the inlet region, the intake or inflow region is partially blocked, and this would have a negative effect upon the delivery volume. In contrast to this, according to the invention, the radially inner inflow region in the region of the shorter intermediary blades is kept open.

With an alternative embodiment which can be protected independently, an annular covering disc is provided which has a wide $R_D$ which, measured from the edge of the intake opening, is smaller than the distance edge—intake opening to discharge opening—circumferential edge.

It is advantageous here to provide the width with proportions such that, measured from the intake opening, it is substantially half the length of a blade. This particular embodiment also makes it possible to produce the fan impeller as a one-piece moulded part, an embodiment being considered to be particularly favourable with which the support disc is annular in form and has an annular width which substantially has the measurement outer edge of covering disc to discharge opening—circumferential edge (2-3').

If this annular width is substantially half the length of a blade, another movement can be provided to the air flow in the discharge region so that the shearing friction between the rear housing wall and the flow is limited to a reduced range.

It can be favourable here for the two disc rings, i.e. that of the covering disc and that of the supporting disc, to either overlap in the projection in the direction of the rotation axis depending upon the requirements, form a gap between them, or complement one another by adjoining to form a circular surface. An advantageous flow course can be achieved if the hub element is of a height which, measured from the level of the rear support disc, substantially corresponds to half the depth of the impeller. A cone is favourably formed on the hub element facing the flow side, the covering disc (2-9) and the cone of the hub substantially have a parallel course in the cross-section A-A. In this way, a favourable flow course is achieved in the inlet region of the impeller.

With one advantageous embodiment provision can be made such that on the outer circumference of the cone a region is formed, the flow surface of which runs substantially parallel to the rotation plane. By means of this design, before leaving the cone region, the flow is given another change in direction gradient which reduces a steep incidence of the flow in the open region of the impeller.

This effect can advantageously be further increased in that the flow surface of the outer circumferential region is disposed in one plane which, in relation to the flow channel, lies further inwards than the surface of the outer support disc defining the flow channel, i.e. the support disc can be designed to be thinner than the thickness of the outer circumferential region of the cone.

An advantageous embodiment can be designed such that the blades are axially wider in the intake region than in the outflow region.

It can also be favourable for at least one intermediary blade respectively to be disposed between the blades substantially in the region of the width of the support disc.

It is particularly favourable for two intermediary blades to be disposed respectively in pairs. It is particularly favourable here for the intermediary blades to have a radial extension which substantially corresponds to the distance between the outer circumference of the covering disc and the outer circumference of the rear-side support disc.

It is particularly advantageous for the intermediary blades to be held exclusively on the rear-side support disc. This embodiment simplifies to a particularly large extent the design of the radial fan impeller as a one-piece cast part.

In summary, the combination of features of claims 1 and 10 according to the invention leads to the following essential advantages of the radial fan impeller:

in particular in co-operation with a suitably adapted fan housing appropriate for producing high pressure or for producing a steep characteristic curve, with which a change to the counter pressure in the unit brings about no or only a slight change to the volume flow.

short axial overall length one-part production using a synthetic spraying method with simple demouldability and in a simple and cost-effective moulding tool can thus be produced cost-effectively.

Further areas of applicability will become apparent from the description provided herein. The description and specific examples in this summary are intended for purposes of illustration only and are not intended to limit the scope of the present disclosure.

DRAWINGS

Figure 2:
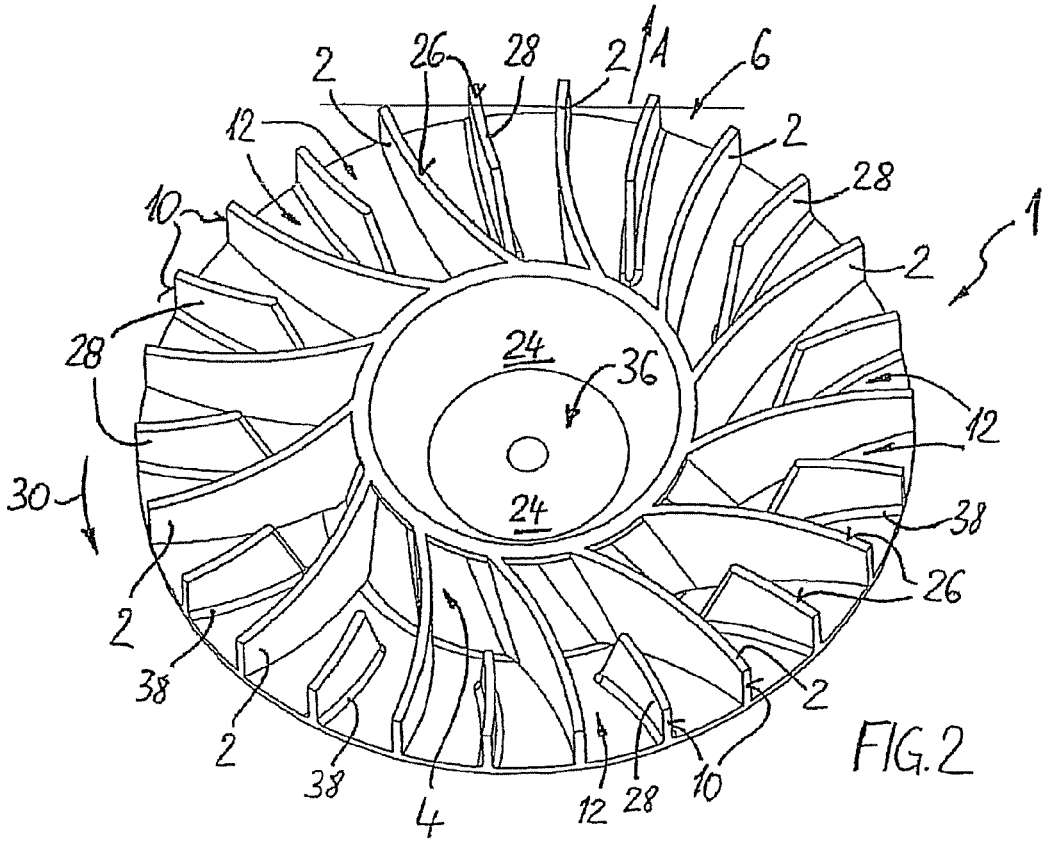
Figure 3:
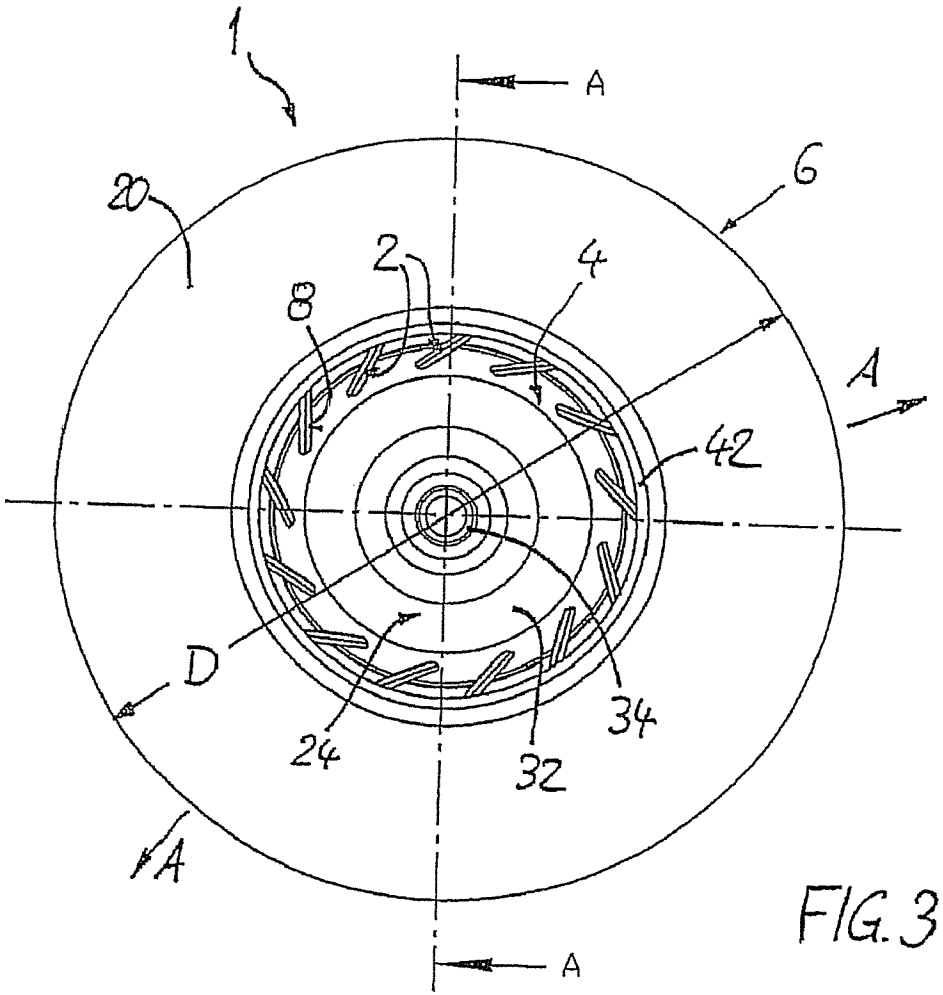
Figure 4:
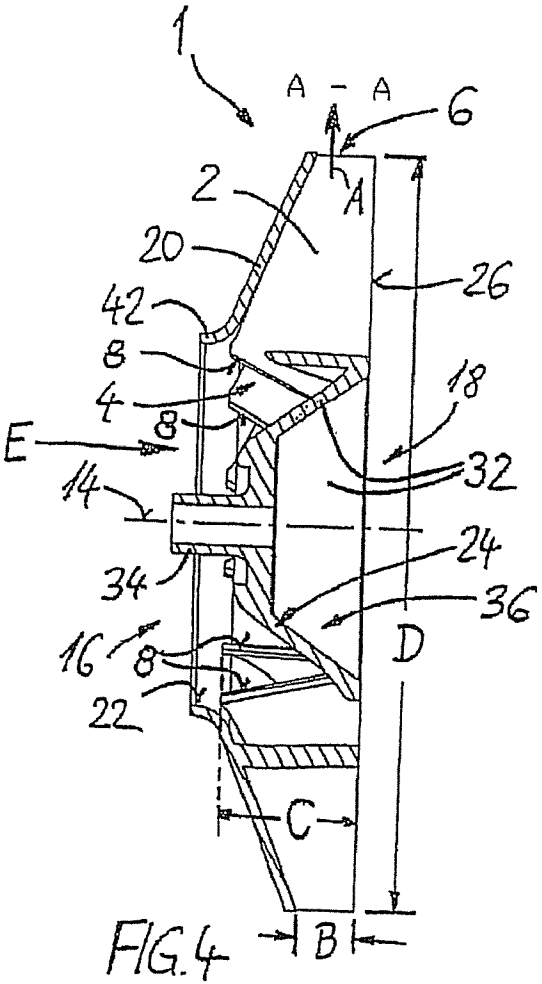
Figure 6:
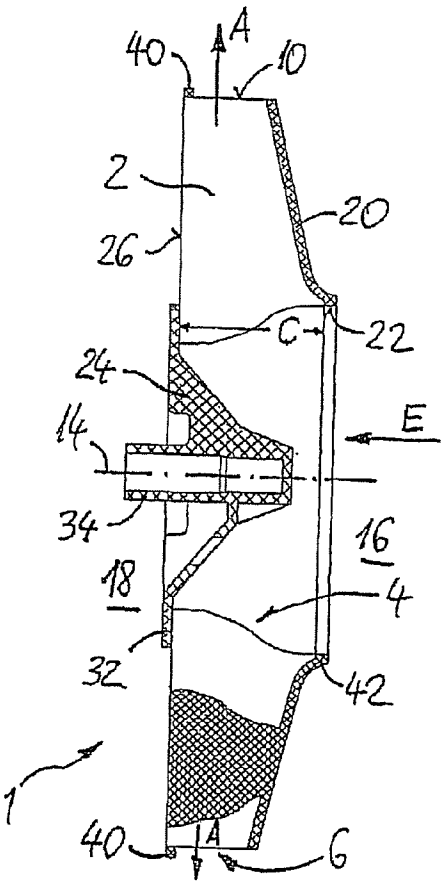
Figure 5:
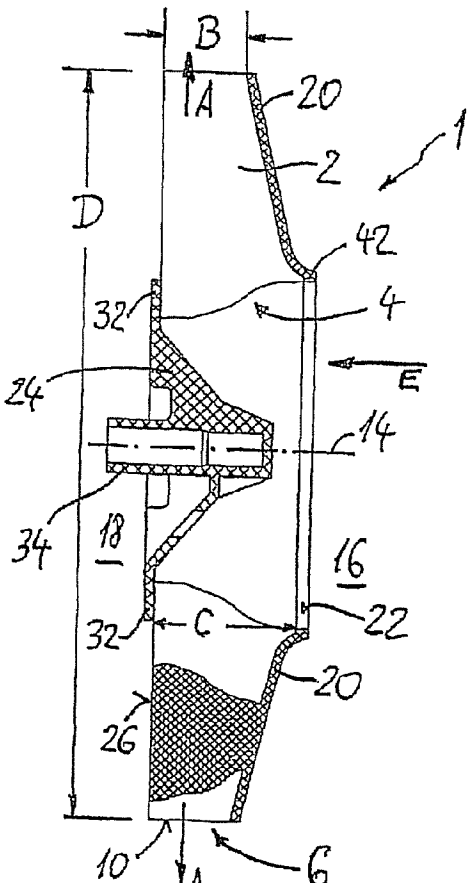
Figure 7:
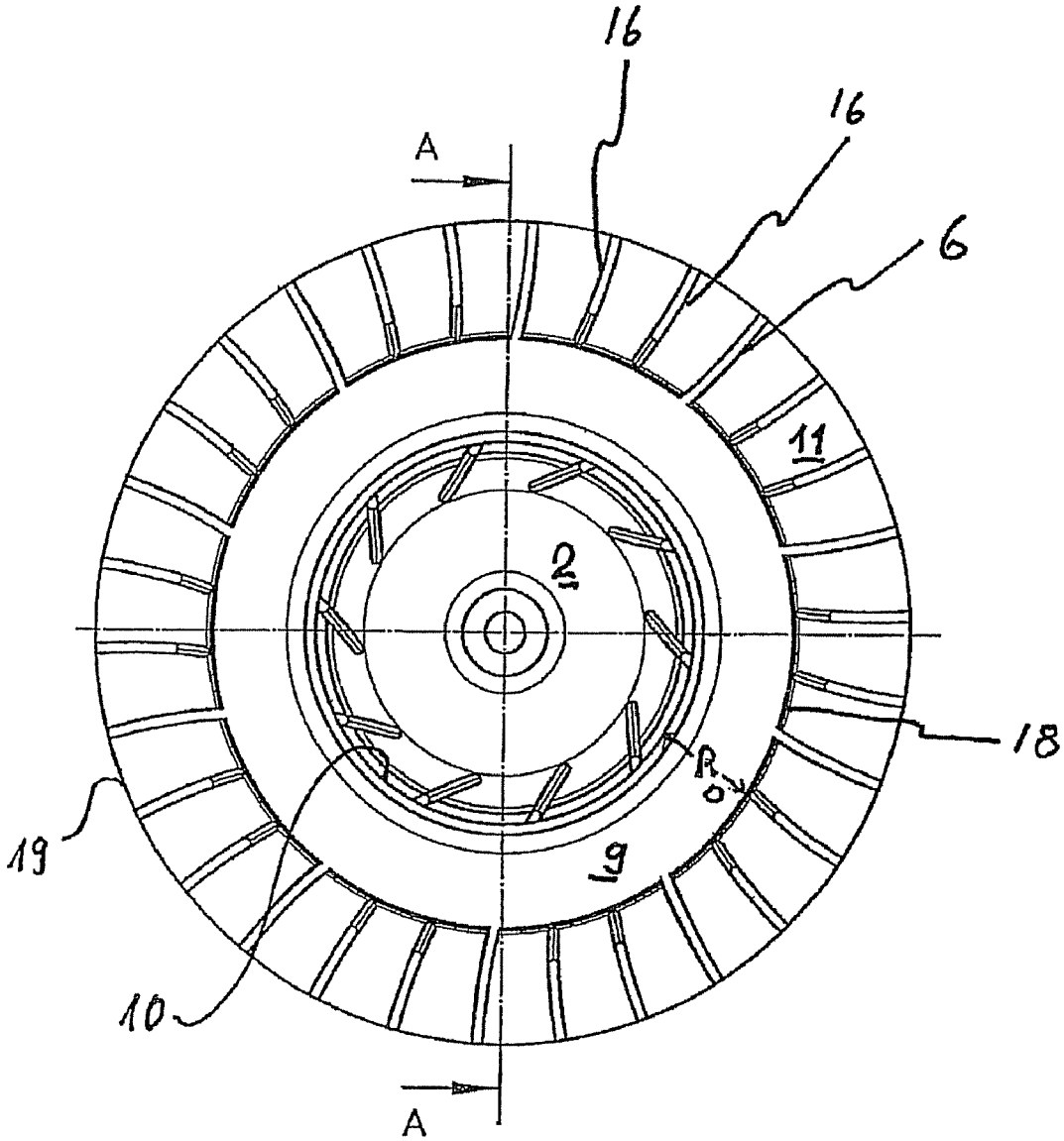
Figure 8:
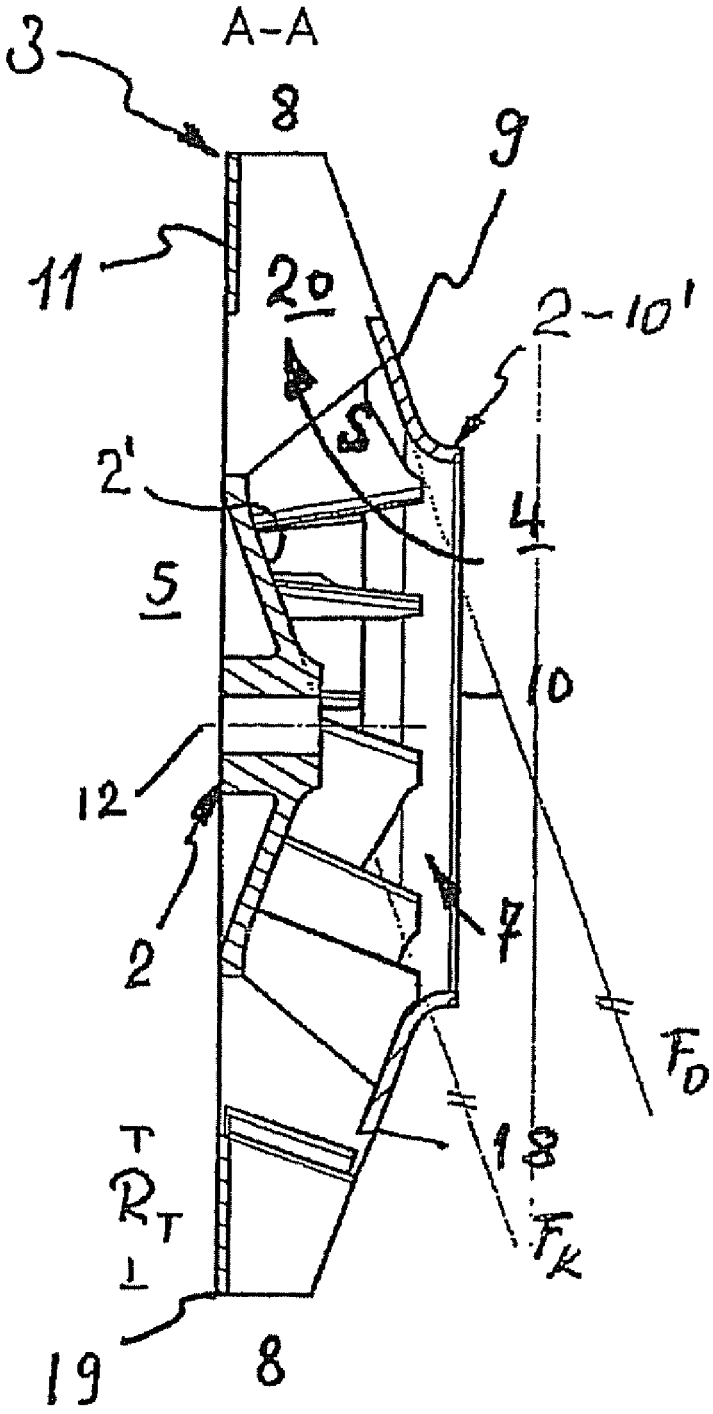

By means of preferred examples of embodiments illustrated in the drawings, the invention will be described in greater detail. The drawings show as follows:

FIG. 1 is a perspective view of a first embodiment of a radial fan according to the invention onto the side of the covering disc, FIG. 2 is a perspective view of the fan impeller according to FIG. 1 onto the other, open side of the blades, FIG. 3 is a top view onto the side of the covering disc, FIG. 4 is a cross-section in plane A-A according to FIG. 3, FIG. 5 is a second embodiment of the radial fan impeller according to the invention in an axial section similar to FIG. 4, FIG. 6 is an illustration similar to FIG. 5 in an advantageous further development, FIG. 7 is a top view of a further embodiment with a reduced covering and support disc, and FIG. 8 is a view of a section along line A_A in FIG. 7.

DETAILED DESCRIPTION

Example embodiments will now be described more fully with reference to the accompanying drawings. In the different figures of the drawings, the same parts are always provided with the same reference numbers.

A radial fan impeller 1 according to the invention consists of a plurality of radial blades 2 distributed around the periphery, which viewed in the radial direction extend from an inner inlet region 4 to an outer discharge region 6. According to FIGS. 1 and 3, the blades 2 have radially inner end edges 8 which lie on a theoretical surface enclosing the inlet region 4, which is approximately cylindrical, but in particular conical, and which tapers viewed in the axial inflow direction (see arrow E in FIG. 1 and FIGS. 4 to 6) into the inlet region 4. Furthermore, the blades 2 have outer end edges 10. Between the blades 2 radial flow channels 12 are respectively formed with the substantially radial outflow direction A.

Furthermore, the blades 2 extend axially, i.e. viewed in the direction of a rotation axis 14, between an inlet side 16 and an axially opposite hub side 18 (see with regard to this the sectional views in FIGS. 4 to 6).

Furthermore, according to the invention the blades 2 are only connected on their inlet side 16 by means of their radial extension as far as the discharge region 6 to a covering disc 20 which has a central inflow opening 22 opening out into the inlet region 4. On the opposite hub side 18, however, the blades are only connected by their radially inner end regions to a central hub 24 so that the flow channels 12 on this side are designed to be open in the axial direction. The blades 2 therefore have free side edges 26 on this side.

As is furthermore evident from FIGS. 4 to 6, the blades 2 and the covering disc 20 define an outer fan impeller diameter D which is at least ten times an axially measured flow discharge width B of the blades provided in the discharge region 6. Preferably, the axially measured inner flow inlet width C of the blades 2 in the inlet region 4 is greater here than the outer flow discharge width in the outlet region 6 (see e.g. FIG. 4).

In a further embodiment according to the invention, radially shorter intermediary blades 28 are connected to the covering disc 20 in regions respectively disposed between adjacent blades 2 (see in particular FIGS. 1 and 2). These intermediary blades 28 extend from the outer circumference of the covering disc 20 over just one portion of the radial extension of the covering disc 20, and end a radial distance away from the hub 24. This can best be seen in FIG. 2. In the example of an embodiment shown, just one intermediary blade 28 is provided between two adjacent blades 2, but two or more intermediary blades 28 can, however, also be provided which can then be designed with the same or a different radial length.

By means of the embodiment according to the invention described, the radial fan impeller 1 can advantageously be produced as a one-piece moulded part made of synthetic, and preferably of a synthetic with anti-static properties such that during operation static charges are avoided or dissipated by a housing (not shown). This contributes to a high level of safety during use, particularly with regard to the preferred application for conveying combustible gas/air mixtures with which ignitions caused by spark formation are avoided.

As is evident from FIG. 2, with this example of an embodiment provision is made such that the blades 2 and the intermediary blades 28, considered in the radial direction, are designed to bend backwards in the direction of rotation 30. The blades are arranged here such that their inlet angle is between approximately 30° and 45°, and their outlet angle is between approximately 45° and 90°. In order to illustrate this angle, reference is made to EP 0 410 271. Alternatively, however, an embodiment with blades 2 and intermediary blades 28 which are bent forwards or end radially in the discharge region 6 are also possible.

The hub 24 consists of an outer disc section 32 and a central mounting section 34 to be connected to a shaft (not shown), in particular in the form of a short pipe appendage. The disc section 32 is connected here on its radially outer periphery to the inner end regions of the blades facing towards the inlet region 4. With the first embodiment according to FIGS. 1 to 4, provision is advantageously made such that the disc section 32 of the hub 24, starting from its outer peripheral region connected to the blades 2, projects for example in a convex or shell-like form into the inlet region 4 and towards the inflow opening 22 of the covering disc 20 such that the hub 24—see in particular FIG. 4 with regard to this—forms an accommodation space 36 for certain (not shown) fan function elements such as mounting elements, engine or rotor parts and/or similar on its side facing away from the inflow opening 22. This advantageous embodiment leads to a short axial overall length of the whole fan.

As is also evident from FIG. 2, (at least) the intermediary blades 28 are connected to the covering disc 20 by means of a respective transition reinforcement 38 formed in the blade base region. Despite the connection-free design spaced apart from the hub 24, this guarantees sufficient stability of the intermediary blades 28.

In a further embodiment of the invention illustrated by FIG. 6, in their radially outer region which lies axially opposite the covering disc 20, the blades 2 and the intermediary blades 28 are connected by means of a circumferential annular element 40 formed as one piece in order to provide mechanical reinforcement.

Finally, it should be mentioned that in the region of the inflow opening 22, the covering disc 20 has an edge 42 in the form of a nozzle in the direction of flow.

In FIGS. 7 and 8, a further embodiment is shown for fulfilling the object according to the invention. Unlike the reference numbers of the preceding examples of embodiments, with the example of an embodiment described now, the reference numbers are provided with a number 2 and a hyphen.

The radial fan impeller 2-1 shown in FIG. 7 has an annular covering disc 2-9 which surrounds the intake region 2-7 in an annular shape. Normally, a circular intake opening 2-10 is formed on the covering disc 2-9 which is surrounded by a circumferential opening lip 2-10'. Furthermore, the radial fan impeller 2-1 has a hub element 2-2 and a peripheral edge 2-3. On its side facing towards the intake opening 2-10, the hub element 2-2 has a cone 2-2'. The fan impeller 2-1 is provided with blades 2-6 extending substantially radially from the hub element 2-2 to the peripheral edge 2-3. An intake region 2-7 and an outflow region 2-8 are defined by the blades.

The annular covering disc 2-9 has a width $R_D$ which, measured from the edge of the intake opening (2-10), is half of the distance edge—discharge opening—circumferential edge 2-3.

The width $R_D$ therefore substantially corresponds to half of the blade length measured along the upper edge of the blade 2-6.

The base of this type of blade is integrally connected at its radially inner point to the hub element. The support disc 2-11 extending on the rear side 2-5 is annular in form, and on its annulus has a width of $R_T$, which, measured from the edge of the intake opening 2-10, is substantially half of the edge discharge opening 2-10—circumferential edge 2-3 measurement. This substantially corresponds to a half blade length measured along the rear side edge of the blade extension between the peripheral edge 2-3 and the base of the blade 2-6 on the cone 2-2' of the hub 2-2.

With such dimensions, as can be seen in FIG. 7, in the projection of the fan impeller onto the plane of the support disc towards the rotation axis, the outer circumference of the covering disc 2-9 and the inner circumference of the support disc 2-11 are congruent. Alternative embodiments can be provided, however, such that both disc rings 2-9; 2-11 overlap or form a gap between them dependent upon the requirement in the projection towards the rotation axis 2-12.

The hub element 2-2 has a height which, measured from the plane of the rear support disc 2-11 substantially corresponds to half of the impeller height. In the example of an embodiment shown, the height of the hub corresponds to half of the height of the blades projecting into the intake opening 2-10.

The surface $F_K$ of the cone 2-2' of the hub 2-2 extends substantially parallel to the inner surface $F_D$ of the covering disc 2-9. In the region of the base 2-14 of the cone, i.e. at its outer circumference, a region 2-21 is formed, the surface of which extends substantially parallel to the rotation plane of the fan impeller. The surface of the cone facing towards the flow and the rotation-parallel region are rounded here. Between the blades 2-6 extending from the edge of the intake opening 2-10 to the peripheral edge 2-3 of the fan impeller 2-1, intermediary blades 2-16 are disposed substantially in the region of the width of the rear-side support disc 2-11. The number of intermediary blades 2-16 can vary depending upon the application. Preferably, with the example of an embodiment shown, two intermediary blades 2-16 are disposed in pairs between two blades 2-6. The radial extension of the intermediary blades 2-16 is of proportions such that it substantially corresponds to the distance 2-17 between the outer circumference 2-18 of the covering disc 2-9 and the outer circumference 2-19 of the rear-side support disc 2-11. With the example of an embodiment shown, the intermediary blades 2-16 are only held on the rear-side support disc 2-11, i.e. the front edge of the intermediary blades with this embodiment are free. Depending upon the arrangement of the covering and the support disc described above, the intermediary blades can however also be moulded onto the covering disc. The form of the course of the intermediary blades corresponds substantially to the corresponding form of the section of the blades 2-6 at a corresponding point.

As with the first example of an embodiment, the previous embodiment can also advantageously be produced as a one-piece moulded part made of synthetic.

The invention is not restricted to the examples of embodiments shown and described, but also includes all embodiments acting in the same way in the sense of the invention.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A radial fan impeller comprising a hub element and a peripheral edge, a front side and a rear side, blades extending substantially radially from the hub element to the peripheral edge, an intake region and an outflow region, an annular covering disc on the front side in which an intake opening is formed with a rear-side support disc, wherein the annular covering disc has a width $R_D$ measured from an outside edge of the intake opening to an outer edge of the annular cover disc, the width $R_D$ is smaller than the distance from the edge of the intake opening to a circumferential outer edge of the discharge opening;

the width $R_D$ is substantially one half of a blade length; and a support disc is annular in form and has an annular width RT which is substantially the measurement of the outer edge of the annular covering disc to the circumferential outer edge of the discharge opening.

2. The radial fan impeller according to claim 1, wherein both the support disc and the annular covering disc overlap in the direction of the rotation axis and form a gap between them or complement one another.

3. The radial fan impeller according to claim 1, wherein the hub element has a height which, measured from a plane of the support disc substantially corresponds to one half of the impeller height.

4. The radial fan impeller according to claim 1, wherein the hub element towards a flow side has a cone, and the annular covering disc and the cone of the hub in a cross-section have a substantially parallel course.

5. The radial fan impeller according to claim 4, wherein on an outer circumference of the cone a region is formed, the surface of the region extending substantially parallel to the rotation plane.

6. The radial fan impeller according to claim 1, wherein at least one intermediary blade is respectively disposed between adjacent blades, substantially in the region of a width of the support disc.

7. The radial fan impeller according to claim 6 wherein two intermediary blades are respectively disposed in pairs.

8. The radial fan impeller according to claim 6, wherein the intermediary blades have a radial extension which substantially corresponds to a distance between the outer edge of the annular covering disc and an outer circumference of the support disc.

9. The radial fan impeller according to claim 6, wherein the intermediary blades are only attached to the support disc.

10. The radial fan impeller according to claim 1 comprising a design as a one-piece moulded part made of synthetic.

11. The radial fan impeller according to claim 10, wherein the moulded part is made of a synthetic with anti-static properties such that during operation, static charges are avoided or dissipated.

* * * * *